United States Patent [19]

Lawrence et al.

[11] Patent Number: 4,843,434

[45] Date of Patent: Jun. 27, 1989

[54] RANDOM ACCESS SHEET RECEIVER

[75] Inventors: Frederick Lawrence, Tustin; George M. Cron, Irvine, both of Calif.

[73] Assignee: Gradco Systems Inc., Irvine, Calif.

[21] Appl. No.: 122,146

[22] Filed: Nov. 17, 1987

[51] Int. Cl.[4] ..... G03B 27/58

[52] U.S. Cl. ..... 355/72; 271/293; 271/294; 271/296

[58] Field of Search ..... 355/72; 271/293, 294, 271/296

[56] References Cited

U.S. PATENT DOCUMENTS

| | | | |
|---|---|---|---|
| 4,162,787 | 7/1979 | Shirahase et al. | 271/293 |
| 4,328,963 | 5/1982 | Dubois et al. | 271/293 |
| 4,466,608 | 8/1984 | Dubois et al. | 271/294 |
| 4,478,406 | 10/1984 | Dubois | 271/296 |

*Primary Examiner*—Monroe H. Hayes
*Attorney, Agent, or Firm*—Newton H. Lee, Jr.

[57] ABSTRACT

A random access sheet receiver is provided with a stack of trays having ends vertically shiftably mounted in a frame structure and forming bins to receive sheets from a copier, printer, or the like, wherein said ends of the trays are normally closely spaced and rest one on the other. A sheet infeed is pivotally mounted in the frame structure to receive sheets exiting from the copier, printer, or the like, the infeed being associated with a bin opening mechanism which raises and lowers the infeed and has a lifter to pivotally open and hold open said ends of the trays during transport of a sheet to a selected bin. The other ends of the trays are supported on cams which increase the space at the other ends of the bins in response to pivotal opening of the trays by the bin opener.

5 Claims, 6 Drawing Sheets

FIG. 5.
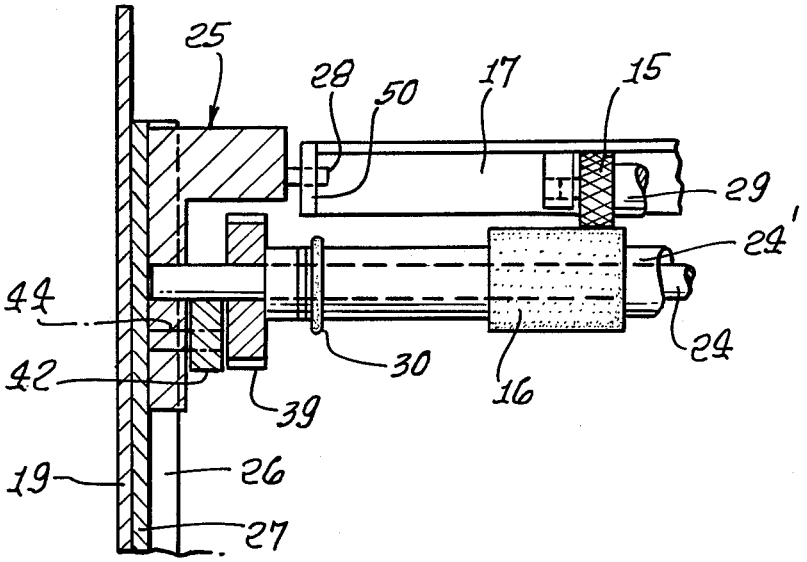
FIG. 11.
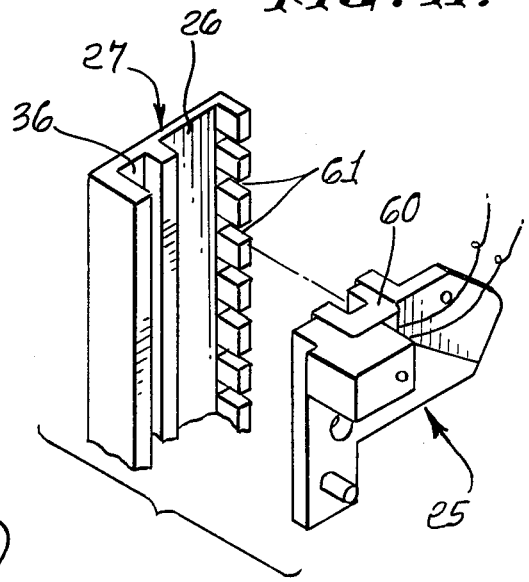
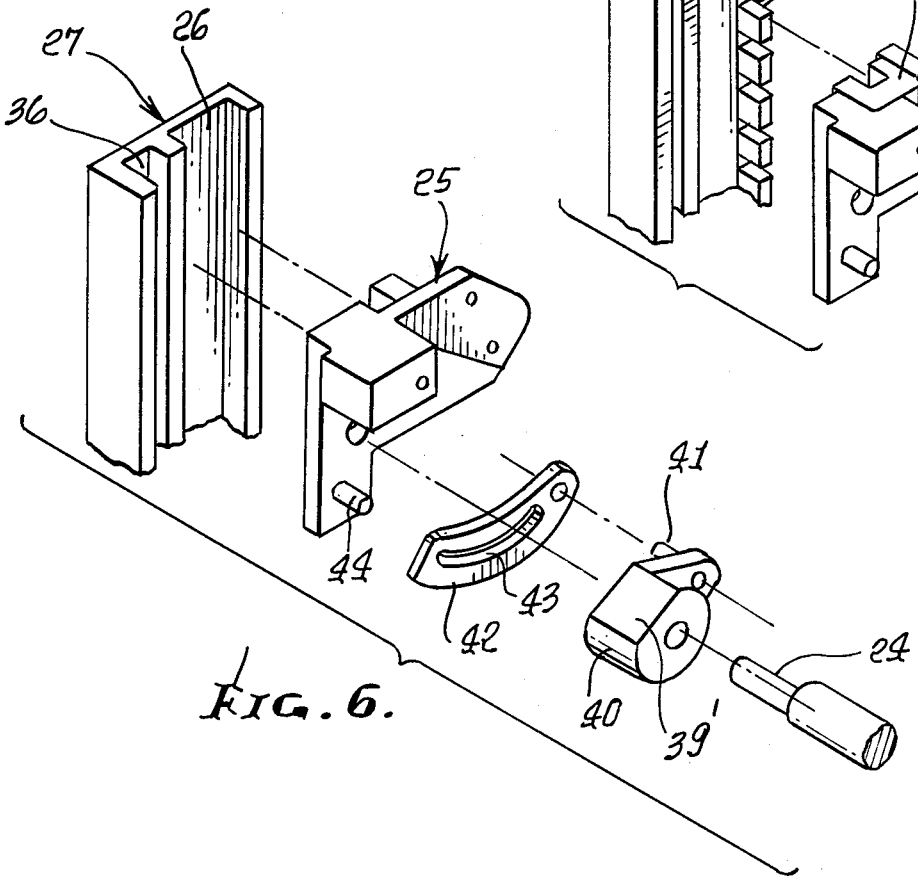
FIG. 6.

RANDOM ACCESS SHEET RECEIVER

BACKGROUND OF THE INVENTION

Receivers for copies exiting from office copiers often include sorting machines which function to arrange the copies in discreet, collated sets. Examples of sorting machines having moving bins or moving bin openers to enlarge the space between receiver trays are well known in the prior art. Examples are shown in various prior United States patents including Lawrence U.S. Pat. No. 4,343,463, Du Bois U.S. Pat. No. 4,478,406 and U.S. Pat. No. 4,328,963, Stemmle U.S. Pat. No. 3,848,868, Schultz and Shirahase U.S. Pat. No. 3,879,032. There are numerous other examples in the prior art of sorters having means to open pivoted bins. Langner U.S. Pat. No. 4,265,445 is an example of sorters wherein the trays are fixed, but a pivoted infeed directs sheets to a selected bin.

Such sorting devices are well suited to the sequential operation employed in bi-directional sorting of multiple copies of original documents made on an office copying machine. The time interval between copies is adequate to allow movement of the bins or the bin openers from one tray to the next sub-jacent or super-jacent tray to collate copies from the low speed to mid-speed copiers, say, up to sixty or more, copies per minute.

With the advent of copying machines which function as printers, i.e., non-impact or electronic or laser printers which employ programmed imaging of a xerographic drum instead of photo-imaging of a hard original, the need has arisen for random access receivers. Such printers normally produce documents in sets, with the pages collated. However, the need exists for mailboxing of different jobs, as well as separation of sets. While set separation can be readily accomplished by feeding the pages of each set into the bins in sequence, mailboxing is more difficult, because the documents or jobs destined for different mailboxes may not and most likely will not be processed in sequence. Thus, mailboxing requires random access or positioning of the sheet feed for delivery to a selected bin or mailbox.

Where high speed, high volume printers are employed, relatively large, costly and complicated random access devices may be employed, such as those shown in Lawrence U.S. Pat. Nos. 4,343,463, or 819,969 as examples, where sheets are gated into a selected bin from or by a sheet transport.

Theoretically, the prior bin opening sorter devices identified above are also useful as mailboxing devices, but the rapid movement of the bins shifting or bin opening mechanisms required in the case of random access of the sheets to the trays poses a timing problem and a mechanical problem of rapidly accelerating the operating mechanism from, say, the first bin to the last bin and back, to separate two successive jobs.

Moreover, the vast majority of the non-impact or electronic printers using xerographic production of the image on the sheets, are small and relatively inexpensive, so that large and expensive or complicated mailboxing devices are not acceptable. While the sorter of Du Bois U.S. Pat. No. 4,328,963 referred to above is useful as a mailbox in conjunction with certain lower speed printers, because of the relatively large sheet capacity per bin for its overall size, such mailboxes are subject to excessive mechanical wear when the bin opening cam is made to move rapidly up and down the trays, while opening each tray in sequence when sheets are to be delivered in a random fashion, and, moreover, such mechanical motion imposes limitations on the sheet delivery speed of a printer with which such sorter is employed in a random access or mailbox fashion.

SUMMARY OF THE INVENTION

The present invention utilizes the features of compactness of the sorter of the type disclosed in the abovementioned Du Bois, et al U.S. Pat. No. 4,478,406 with bin opening mechanism which adapts the sorter to relatively high job separation due to the speed and ease of random access operation, with the result that a small, compact and simple set or job separating receiver is provided, having, for its size, high capacity in terms of sheets per bin. The device also may be utilized in conjunction with a copier as a sorter with a job separation feature.

More specifically, the present invention comtemplates the use of a stack of trays mounted at inner ends thereof for vertical movement in a frame structure on trunnions or mounting pins and projecting from the frame structure, the outer ends of the trays being the inner ends of the trays normally resting one on the other, and supported for pivotal and sliding movement of the trays on cam surfaces which increase the space between the outer ends of the trays when the inner ends of the trays are vertically shifted apart in the frame structure to increase the space between the inner ends of the trays, and wherein a sheet infeed mechanism is supported in the frame structure so that the infeed can be vertically shifted to positions at the inner ends of selected pairs of adjacent trays, and a bin opener, which moves vertically with the sheet infeed, is operable to vertically open the inner ends of adjacent trays and hold them open as a sheet enters the bin between the trays. In accordance with a feature of the invention the bin opener engages between the trunnions of adjacent trays and supports the weight of sheet infeed mechanism.

The invention has features and advantages which will be best understood by those skilled in the art upon reference to the accompanying drawings and the following more detailed description.

BRIEF DESCRIPTION OF THE DRAWINGS

FIG. 5 is a fragmentary vertical section on the line 5—5 of FIG. 2;

FIG. 6 is an exploded detail view on perspective showing certain details of the bin opening mechanism;

FIG. 11 is a fragmentary view showing a modification of the invention enabling positioning of the bin opener and sheet feed mechanism.

DETAILED DESCRIPTION

Figure 1:
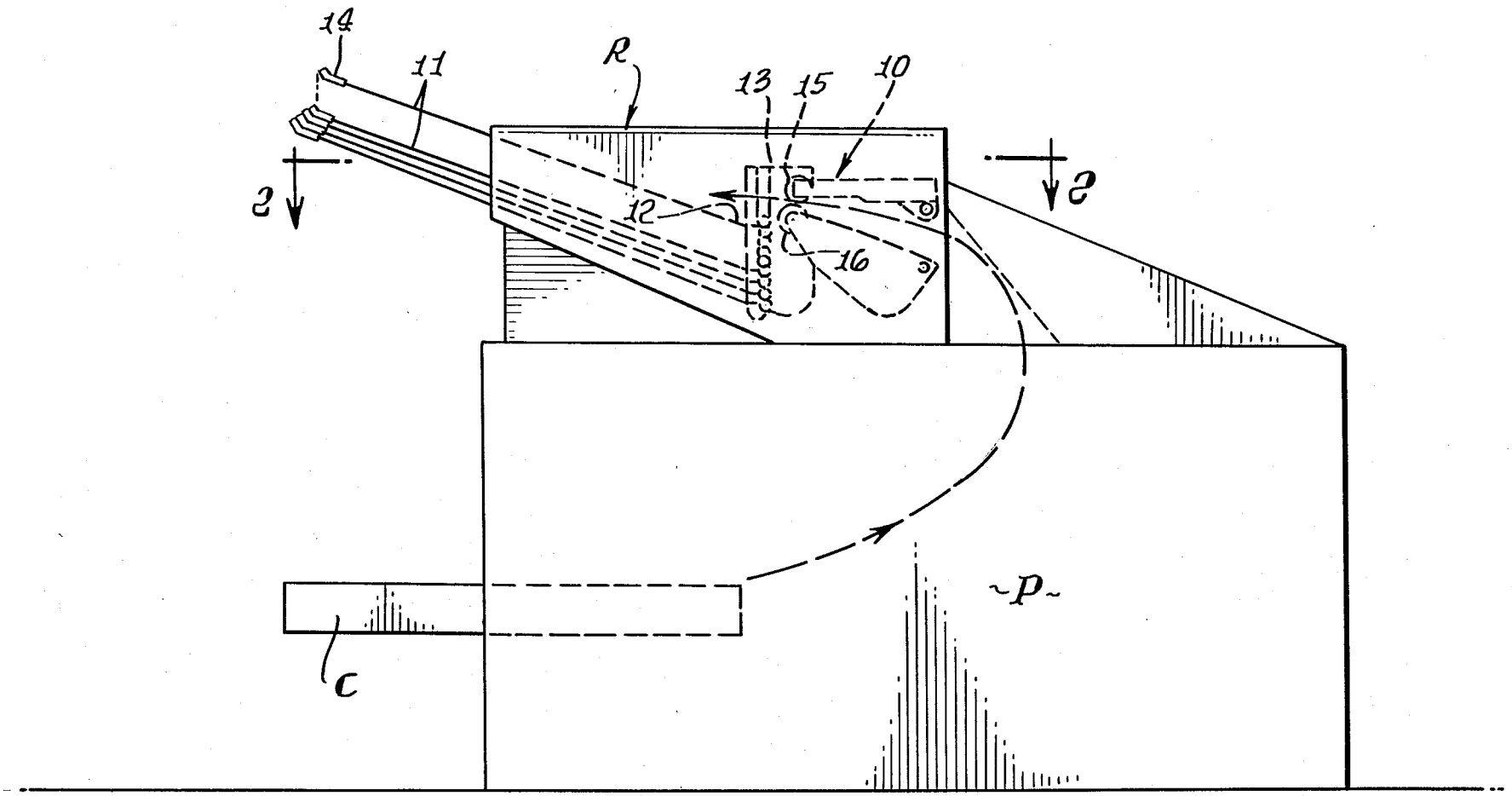
FIG. 1 is a side elevation showing a sheet receiver in accordance with the invention in association with an electronic printer.

As seen in the drawings, referring first to FIG. 1, a random access sheet receiver R, made in accordance with the invention, is located on top of a printing apparatus P and adapted to receive sheets of paper fed to the printer from a supply cassette C, in the direction of the arrows, through the printer to the sheet infeed mechanism 10 of the receiver R so as to be directed to a selected tray 11 of the receiver.

The trays 11, as will be more fully described hereinafter, have inner ends 12 mounted in a frame structure 13 so as to be vertically movable with respect to one another to provide a vertically expanded or opened bin to receive sheets, while normally the inner ends of the trays are stacked or rest one on the other in closely spaced or compact relation.

At their outer ends 14 the trays are supported one on the other on cam-like tips which allow the trays to pivot open at their outer ends, as will later become apparent, and which in response to vertical separation of the inner ends of the trays, vertically spread the outer ends of the trays. Such cam tips are more particularly disclosed in Du Bois U.S. Pat. No. 4 328,963 referred to above, such description being incorporated herein by reference.

The infeed 10 includes infeed rolls 15 and 16 adapted to transport sheets into the trays 11 during operation of the apparatus. The infeed 10 includes an upper infeed guide 17 and a lower infeed guide 18 extended transversely of the side walls 19 and 20 of the frame or support structure of the apparatus. Sidewalls 19 and 20 have support blocks 21 on which the upper and lower guides are pivotally and horizontally shiftably mounted in slots 22 by pins 23. The guides 17 and 18 converge towards the inner ends 12 of the trays 11. The lower guide 18 is mounted upon a transversely extended shaft 24 rotatably mounted in support blocks 25 which are vertically shiftably disposed in slots 26 in tray and infeed support members 27 disposed at opposite sides of the frame structure of the receiver. The upper guide member 17 is also connected to the support blocks 25 at opposite sides of the frame structure as by pivot pins 28. Thus it is seen that the guide members 17 and 18 will be caused to move pivotally along with vertical movement of the support blocks 25 and that the sliding support for the pins 23 allow such straight line vertical movement by reason of the horizontal sliding fit of the pins 23 in the slots 22 of the blocks 21.

A hollow shaft 24' is disposed about the shaft 24 and carries the infeed rolls 16. These rolls 16 are of a resiliant material and are opposed by the pressure rolls 15 which, as seen in FIG. 2, are mounted upon a horizontally extended shaft 29 rotatably supported by the upper guide member 17.

Figure 2:
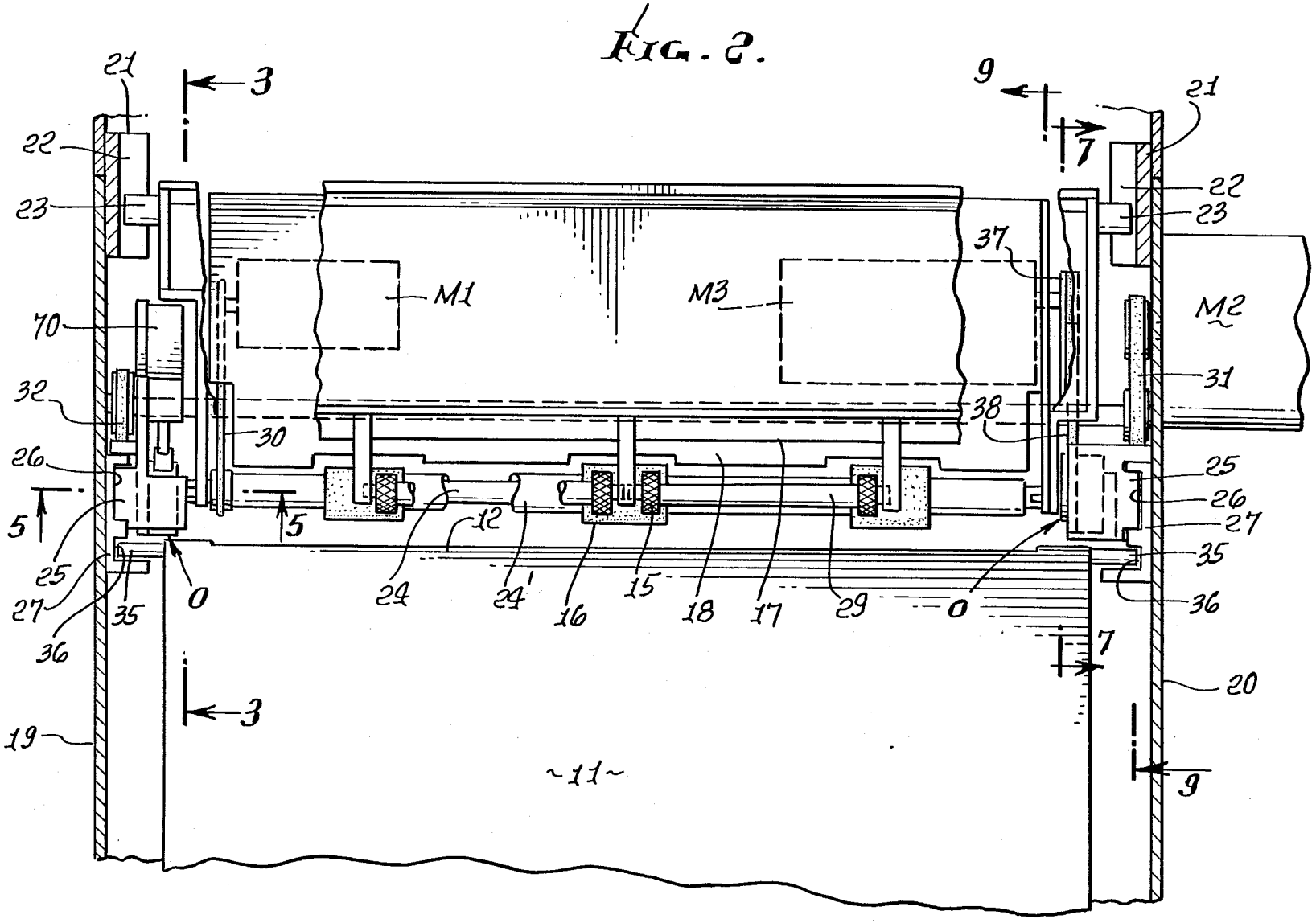
FIG. 2 is a fragmentary horizontal section on the line 2—2 of FIG. 1.
Figure 9:
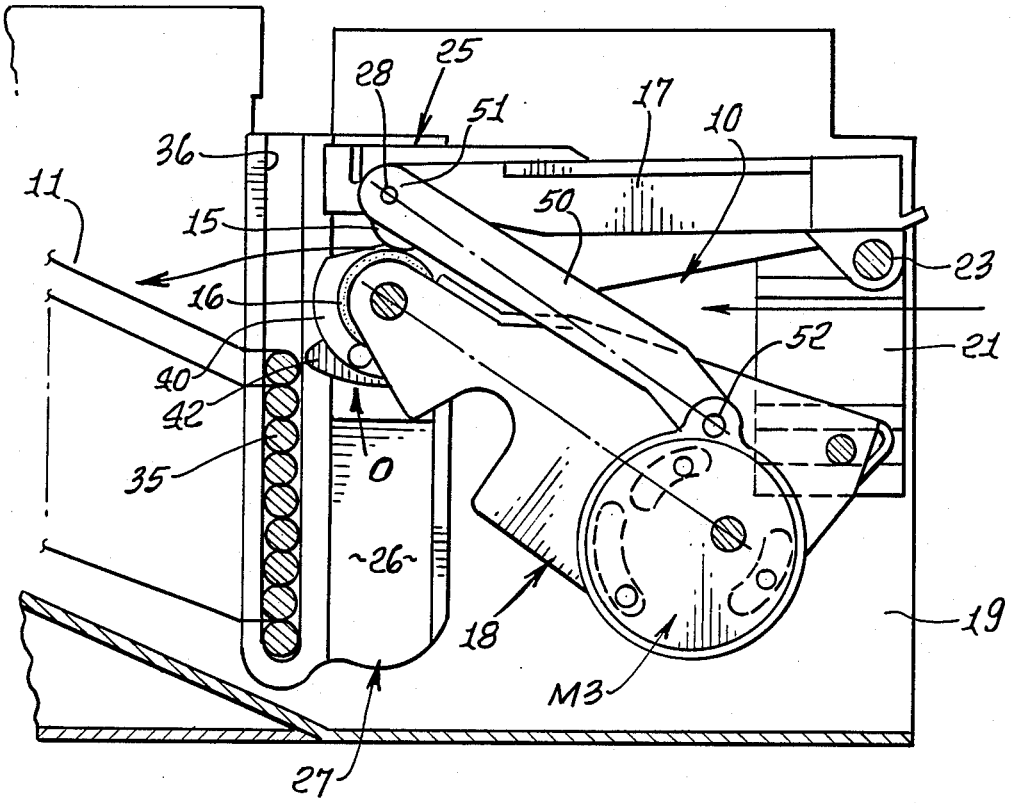
FIG. 9 is a vertical section on the line 9—9 of FIG. 2, with the trays and the infeed in the position of FIGS. 3 and 7.
Figure 10:
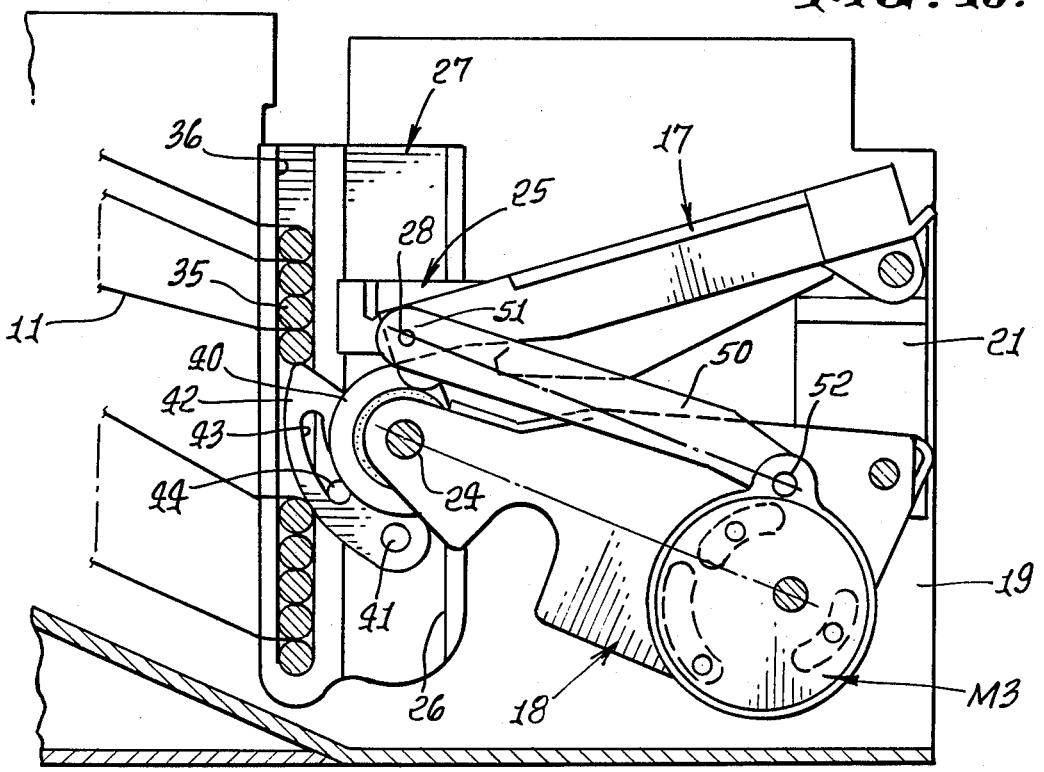
FIG. 10 is a view similar to FIG. 9 but, as in FIGS. 4 and 8 showing the infeed and bin opener in an intermediate position with a bin opened to receive a sheet.

Shaft 24' of the infeed mechanism is adapted to be rotated by a infeed motor M1 which drives a belt 30, as best seen in FIG. 2, whereby sheets fed into the infeed 10 from the printer P are engaged between the resiliant rolls 16 and the pressure rolls 15, so as to be fed in to the receiver trays, as shown in FIGS. 9 and 10.

In order to vertically shift the support blocks 25 in the vertical slots 26, a motor M2 is fixed on the frame structure and has a belt drive 31 having a run 32 extending vertically and parallel to the slot 26 in the side support block 25 at one side of the frame structure. The vertical belt runs 32 are connected by fasteners 33 to the blocks 25, so that each of the support blocks 25 can be raised and lowered in the slots 26 in unison, and the infeed mechanism correspondently raised and lower at its inner end whereby the infeed rollers will feed sheets into a selected tray.

The trays 11 have at their inner ends 12 supports or trunnions 35 which project laterally into vertical slots 36 provided in the support blocks 27, the trunnions normally resting one upon the other, with the lower most trunnion resting on the bottom of the slots 26. Under these circumstancethat the trays are closely spaced a distance equal to the diameter of the trunnions or other spacer, if any, attached to the inner tray ends. Under the circumstances that the infeed mechanism is in the uppermost position shown in FIGS. 3, 7 and 9 sheets supplied to the infeed will be fed onto the uppermost tray.

In accordance with the invention, it is desired that the apparatus function to selectively vertically spread or open adjacent trays to provide an increased bin capacity. Such opening of the trays are shown in FIGS. 4, 8 and 10.

To accomplish the opening of the trays, just referred to, the invention provides a bin opener mechanism O adapted to be vertically moved by the vertical movement of the infeed support blocks 25, whereby when the bin opening mechanism O is activated to open a bin, the infeed mechanism will feed sheets into the open bin. A bin opener motor M3 is mounted on one side of the lower sheet guide 18 and has a gear driven sprocket 37 engaged by a belt 38 which also extends about a sprocket 39 mounted on the shaft 24. The sprocket 39 is formed as part of a lever 40 on which is pivotally supported by a pivot pin 41 a bin opening finger 42. A similar lever 40 and finger 42 are located at the other side of the assembly on shaft 24 for operation in unison responsive to motor M3. Each finger 42 has a arcuate cam slot 43 through which extends a pin 44 which is outwardly extended from and carried by the respective infeed support blocks 25. Thus angular motion of the respective levers 40 will cause either outward projection of or retraction of the bin opening fingers 42, between the positions shown in FIGS. 3 and 4, 7 and 8, and 9 and 10 respectively.

Figure 4:
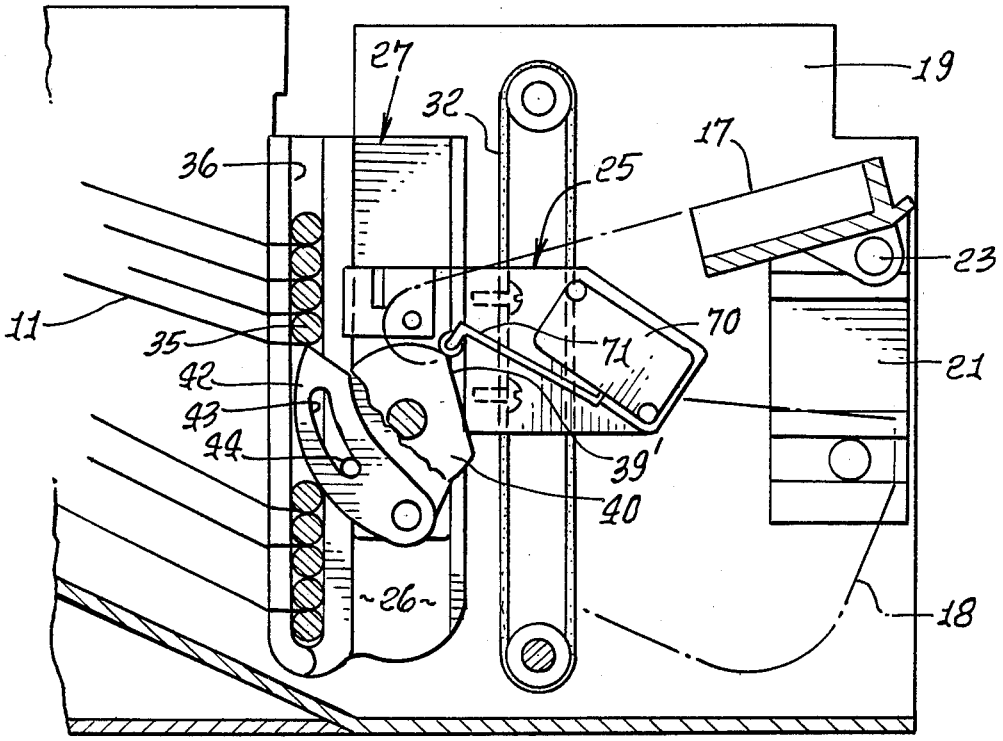
FIG. 4 is a view similar to FIG. 3, but showing a pair of trays opened to provide a bin of increased height with the sheet infeed positioned to feed sheets into the opened bin.
Figure 8:
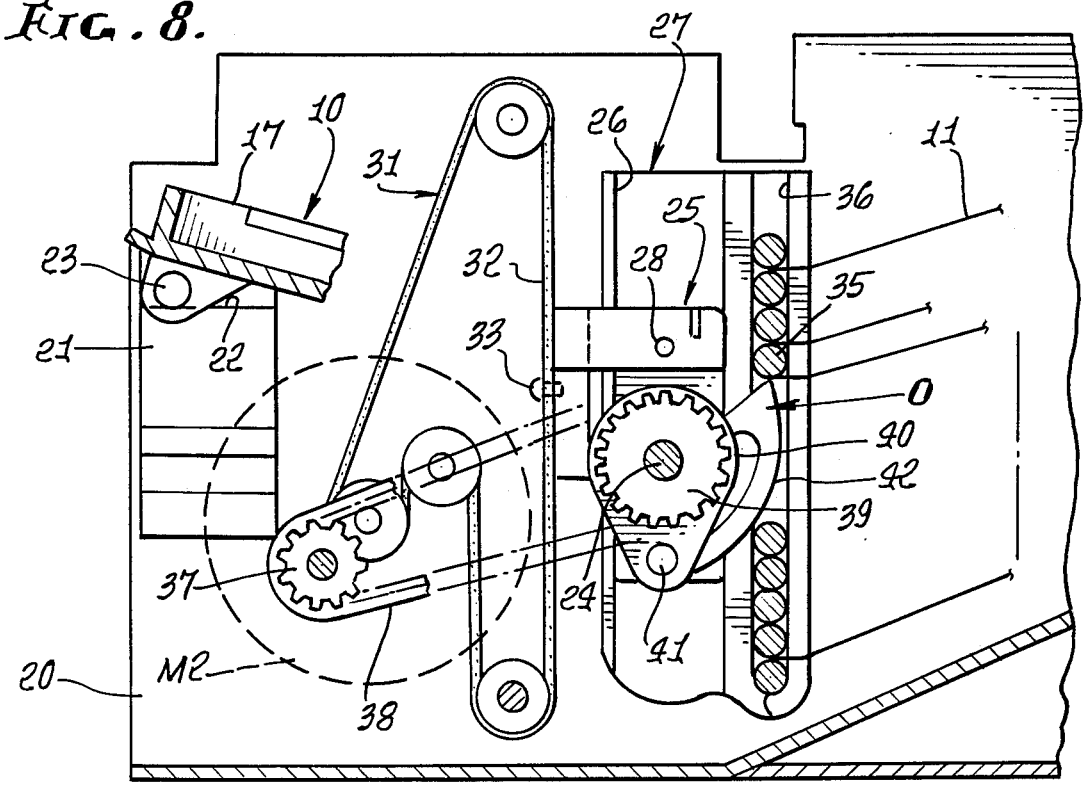
FIG. 8 is a view similar to FIG. 7, but as in FIG. 4, showing a pair of trays opened by the bin opener.

When the bin opener O is at a location such as that shown in FIGS. 4, 8 and 10, and the levers 40 are rotated in a clockwise direction, the fingers are caused to project outwardly, by camming engagement of the pins 44 in slots 43 so that the end of the fingers 42 will engage beneath a trunnion of one tray to lift the latter, together with the trunnions of any trays there above in the slots 36, so that the pair of adjacent trays engaged by the lifter fingers and are vertically spaced. At the same time, it will be noted that the trunnions engaging outer surface 45 of the bin opener fingers 42 is parallel to the curvature of the slot 43 and contacts the lower trunnion of the spaced part bins, thereby forming a positive block against downward movement of the infeed mechanism, so long as the fingers 42 are extended to engage the trunnions between adjacent trays.

Because the path of the drive belt 38 between the motor M3 and the drive sprocket 39 for shaft 34 is of constant length, the sprocket 39, being vertically shiftable, will move toward and away from the center of the motor sprocket 37 during change of length is provided. The motor M3 is rotatively supported upon the lower sheet guide 18 so as to rotate slightly about its center. A link 50 is connected at 51 to pin 28 at the inner end of the upper sheet guide and that 52 to the outer periphery of the motor, with the pins 28 & 52 and the center of the shaft 24 and the center of the motor M3 on parallel planes, whereby upon relative angular motion of the lower sheet guide 18 and the vertical motion of the shaft 24, the motor M3 will be caused to be angularly moved, thereby compensating for the change in the distance between the centers of the sprockets 37 and 39, so that the lift fingers will not be accuated during vertical shifting of the bin opening mechanism.

The motor M2 which is adapted to shift the bin opening mechanismm O and the sheet infeed vertically may be suitably controlled to establish the position of the bin opener O at a location between selected trays. For example, motor M2 may be a stepper motor controlled by signals from the printer or a printer controller to vertically position the bin opener. However, in FIG. 11, there is shown a modified structure for controlling the supply of electricity to the motor M2. Here a light sensor 60 mounted on the vertically movable block and adapted to sense light passing through vertically spaced notches 61 in the side supports 27 corresponding with the positions at which the bin opener O is to be stopped.

Figure 3:
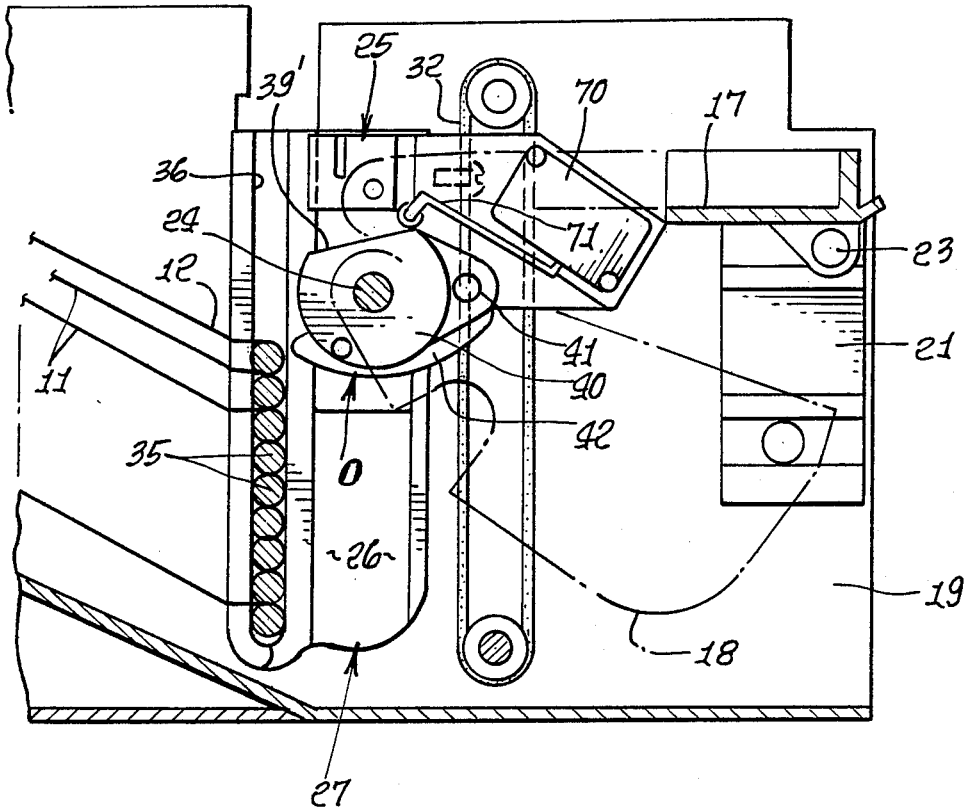
FIG. 3 is a vertical section on the line 3—3 of FIG. 2, showing the trays of the receiver stacked one on the other in condition to receive sheets in the upper tray.

In order to control rotation of sprocket 39 and levers 40 on shaft 24 on which levers 40 are mounted, to limit and reverse this direction of rotation, the hub of one of the levers, as best seen in FIGS. 3,4 and 6 has a cam surface interrupted by a flat 39' for controlling a microswitch 70 connected in circuit with the motor M3 so that the motor is stopped by the usual control circuitry when the arm 71 of switch 70 engages one of the crests at the ends of the flat 39'. It is deemed unnecessary to specifically disclose herein the control circuitry or systems for timing and controlling operation of the receiver. Such controls may be incorporated in the receiver or in the host copier or printer, or both.

Figure 7:
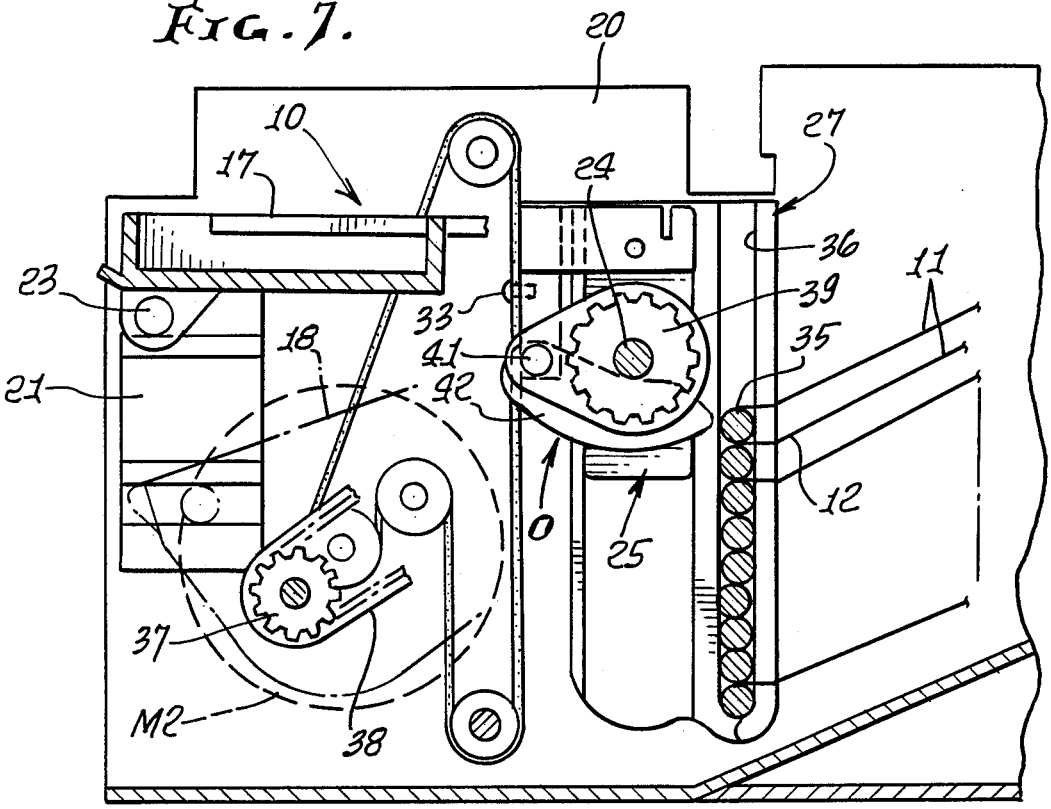
FIG. 7 is a vertical section on the line 7—7 FIG. 2, with the trays and bin opener in the position of FIG. 3.

In operation, assuming the apparatus is conditioned as seen in FIGS. 3,7 and 9, printed sheets supplied from the printer (or copier) enter the sheet infeed 10 and are carried by the transport rolls into the top tray 11. However, if under the control of the control system, it is desired that the next sheet be deposited in the bin defined between the trays which are fourth and fifth from the top, motor M2 is energized in a direction to lower the bin opener 0 and the infeed 10 to the position of FIGS. 4, 8 and 10, prior to operation of motor M3. Then motor M3 is energized to angularly move levers 40 clockwise until micro switch 70 stops motor M3. During angular movement of levers 39, lift fingers 42 are forced outwardly to engage beneath the trunnions fourth from the top, lifting all trunnions and trays there-above. When motor M3 stops, the outer, curved surface of the lift fingers 42 engage the fifth trunnions from the top to hold the infeed and tray opening mechanism vertically positioned, as a sheet is fed into the open bin.

The opposite energization of motor M2 will reverse rotation of shaft 24, causing retraction of the lift fingers 42. Then, motor M2 can be energized in either direction as instructed, to vertically move the bin opener 0 and sheet infeed 10 to another selected position, either at random or sequentially.

We claim:

1. A sheet receiver comprising a stationary frame structure, a plurality of trays having inner ends mounted in said frame structure for vertical movement, the other ends of said tray being pivotally mounted, said inner ends of said trays normally resting one on the other in closely spaced relation, sheet guide freely vertically shiftably mounted in said frame structure and having sheet infeed means to deliver sheets to said trays, bin opener means associated with said sheet guide and vertically freely movable therewith, shifting means for vertically shifting said sheet guide and said bin opener means vertically to positions adjacent selected closely spaced inner ends of said trays, said bin opener means having a lifter engageable between adjacent closely trays and operable to lift each tray thereabove to form an enlarge bin space between the tray next above and the tray next below said lifter, and means for actuating said lifter when said bin opener mean is in one of said positions.

2. A sheet receiver as defined in claim 1, wherein the other ends of said trays are pivotally mounted on cam surfaces to increase the space between said other ends upon opening of the first-mentioned ends by said bin opener means.

3. A sheet receiver as defined in claim 1, wherein the inner ends of said trays have support pins projecting outwardly from opposite sides thereof, said frame structure having vertical slots slidabaly receiving said pins, said bin opener means including lifter fingers at opposite sides of said trays.

4. A sheet receiver as defined in claim 3, wherein said fingers have a surface engaging between the pins of the trays next above and next below said fingers and blocking said trays against movement towards one another upon lifting of the trays above said fingers.

5. A sheet receiver as defined in claim 1, wherein said frame structure has vertically extended slots at opposite sides of said trays, said sheet infeed means having supports for said infeed means and said bin opener means vertically shiftably mounted in said slots, and said shifting means are connected to said supports to raise and lower said supports for side sheet feed means and said bin opener means.

* * * * *